US006090203A

United States Patent [19]

Gebhardt et al.

[11] Patent Number: 6,090,203

[45] Date of Patent: Jul. 18, 2000

[54] BOWLING LANE OIL APPLICATION DEVICE AND METHOD

[75] Inventors: Bruce W. Gebhardt; Richard E. Knipe, Jr., both of Chestnut Ridge, N.Y.; Robert K. Johnson, Naugatuck, Conn.

[73] Assignee: U.S. Polychemical Corporation, Chestnut Ridge, N.Y.

[21] Appl. No.: 09/073,489

[22] Filed: May 6, 1998

[51] Int. Cl.[7] ..... B05B 3/00

[52] U.S. Cl. ..... 118/305; 118/323; 239/752; 239/753

[58] Field of Search ..... 427/421; 118/300, 118/305, 323; 239/752, 753

[56] References Cited

U.S. PATENT DOCUMENTS

| | | | |
|---|---|---|---|
| 2,763,019 | 9/1956 | Huber | 15/131.05 |
| 3,787,916 | 1/1974 | Akagi et al. | 15/4 |
| 3,998,387 | 12/1976 | Maasberg | 239/102 |
| 4,209,557 | 6/1980 | Edwards | 427/373 |
| 4,937,911 | 7/1990 | Picchietti, Sr. et al. | 15/320 |
| 4,959,884 | 10/1990 | Ingermann et al. | 15/302 |
| 5,109,791 | 5/1992 | Matsumoto et al. | 118/63 |

FOREIGN PATENT DOCUMENTS 1001919 6/1997 Netherlands .

*Primary Examiner*—Shrive Beck
*Assistant Examiner*—Jennifer Calcagni
*Attorney, Agent, or Firm*—Notaro & Michalos P.C.

[57] ABSTRACT

An apparatus and method for applying a liquid dressing to a bowling lane has a chassis with wheels to guide the chassis along the longitudinal length of the lane. A spray nozzle for spraying the liquid dressing onto the bowing lane is mounted to reciprocation on the chassis and in a transverse direction parallel to the transverse width of the bowling lane. A metering valve meters liquid dressing to the spray nozzle as the spray nozzle moves in the transverse direction and at controlled velocity for applying the dressing in a selected profile across the transverse width of the lane.

19 Claims, 11 Drawing Sheets

BOWLING LANE OIL APPLICATION DEVICE AND METHOD

FIELD AND BACKGROUND OF THE INVENTION

The present invention relates to a new and useful method and apparatus for applying a dressing such as mineral oil or the like, to the surface of bowling lanes, in a desired pattern for the dressing cross and along the lane.

Rules concerning the application of dressing in a lateral pattern across bowling lanes have been established by the American Bowling Congress. Such dressing is usually in the form of an oil, such as a mineral oil, and is used to protect the surface of the bowling lane from ball impact and friction.

Various types of bowling lane oiling machines and other liquid applying machines for use on planar surfaces, are known.

Bowling lane oiling machines are disclosed, for example, in U.S. Pat. No. 5,679,162, U.S. Pat. No. 5,517,709 and U.S. Pat. No. 5,455,977, all issued to Caffrey et al. and assigned to AMF Bowling, Inc. These patents disclose a bowling lane dressing applicator which moves between the foul line and pin pit, applying dressing, or oil, across the width of the lane as it moves.

U.S. Pat. No. 5,650,012 to Davis teaches a variable speed bowling lane maintenance machine. The machine can be used to apply lane dressing or to clean the lane and may be moved at variable speeds during application to change the oiled lane profile.

Oiling machines which control the amount of lane dressing applied by controlling the contact of a wick with the applicator member are disclosed in U.S. Pat. No. 5,274,871 to Smith et al., assigned to AMF Bowling, Inc., and U.S. Pat. No. 5,181,290 to Davis et al. U.S. Pat. No. 4,980,815 and its Reexamination Certificate B1 4,980,815 assigned to The Kegel Company, Inc. are also relevant for their disclosure of a bowling lane dressing device which, in one embodiment, uses a nozzle which sprays dressing onto an applicator, the applicator in turn applying the dressing to the bowling lane. The applicator is in the form of a drum which receives the dressing and then rolls it onto the bowling lane. It has never been practical to spray dressing directly onto the bowling lane.

A manual applicator for applying a liquid in a coating on a planar surface is disclosed in U.S. Pat. No. 5,050,530 to Studebaker et al. The applicator has a reservoir for holding the liquid being applied. The liquid is dispensed adjacent a pair of parallel wick pads oriented perpendicular to the direction of movement. The wick pads spread the dispensed liquid as the applicator is pulled over the liquid.

U.S. Pat. Nos. 4,766,016 and 4,727,615 to Kubo teach bowling lane dressing applicators using a biasing means, such as a spring or air cylinders, to position the applicator to provide a thin, uniform coating.

A track-mounted applicator and cleaner for bowling lanes is disclosed by U.S. Pat. No. 4,134,361 to Benjamin. The applicator has two rollers which are brought into contact with the bowling lane at the pit end, moved to the foul line to clean the lane, and back to the pit again while applying lane oil. Oil is metered to the applicator to ensure even coating.

U.S. Pat. No. 3,785,001 issued to Niemi et al. and assigned to Brunswick Corporation, discloses a bowling lane finish applicator.

Other patent disclosing bowling lane oil applicators include U.S. Pat. No. 3,319,600 to Regan, U.S. Pat. No. 3,273,532 to Brzuskiewicz et al., U.S. Pat. No. 3,240,184 to Le Mieux et al., U.S. Pat. No. 3,042,950 to Ludwig et al. and U.S. Pat. No. 2,763,019 to Huber. Each of these applicators is manually operated and the coating is applied to the bowling lane by pads or dispensed liquid is spread by a blade.

Other devices are also known for applying a coating liquid to a floor. See, for example, U.S. Pat. Nos. 5,109,790 and 5,109,791, both to Matsumoto et al. These patents disclose a vehicle which can be driven across a floor in a foward direction. A liquid feed device is mounted for transverse movement on the vehicle and, with forward movement of the vehicle and transverse movement of the feed device, a zig-zag pattern of liquid can be laid onto the floor surface.

The foregoing patents to Matsumoto, et al are not adapted for applying dressing to a bowling lane nor do they teach or suggest how different thicknesses of dressing can be applied with a specific profile across the width of the bowling lane.

The inventors are generally aware of prior art whereby a spray head reciprocates back and forth across the top of a roller for applying bowling lane dressing to the roller, the roller thereafter being rolled into contact with the lane for applying the dressing to the lane. It is not known whether the dressing can be applied with a selected pattern across the width of the lane, nor how this can be done with the known apparatus.

SUMMARY OF THE INVENTION

It is an object of the present invention to provide an apparatus and method which is capable of applying a dressing across the width and along the length of a bowling lane in any desired pattern and in an efficient and economic manner.

Accordingly, another object of the invention is to provide an apparatus for applying a liquid dressing to a bowling lane having a longitudinal length and a transverse width, comprising: a chassis; guide means connected to the chassis for guiding the chassis for movement along the bowling lane in a longitudinal direct parallel to the longitudinal length and at a longitudinal velocity; at least one spray nozzle for spraying the liquid dressing onto the bowing lane; reciprocation means connected between the chassis and the spray nozzle for moving the spray nozzle in a transverse direction parallel to the transverse width of the bowling lane and at a transverse velocity; metering means for metering liquid dressing to the spray nozzle as the spray nozzle moves in the transverse direction for applying a selected rate of the dressing in a selected pattern across the transverse width; and dressing profile means connected to at least one of the reciprocation and metering means, for varying at least one of the transverse velocity, the selected rate and the selected pattern, for applying the liquid dressing to the bowling lane in a selected profile.

Thee various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

Its

DESCRIPTION OF THE PREFERRED EMBODIMENTS

Figure 1:
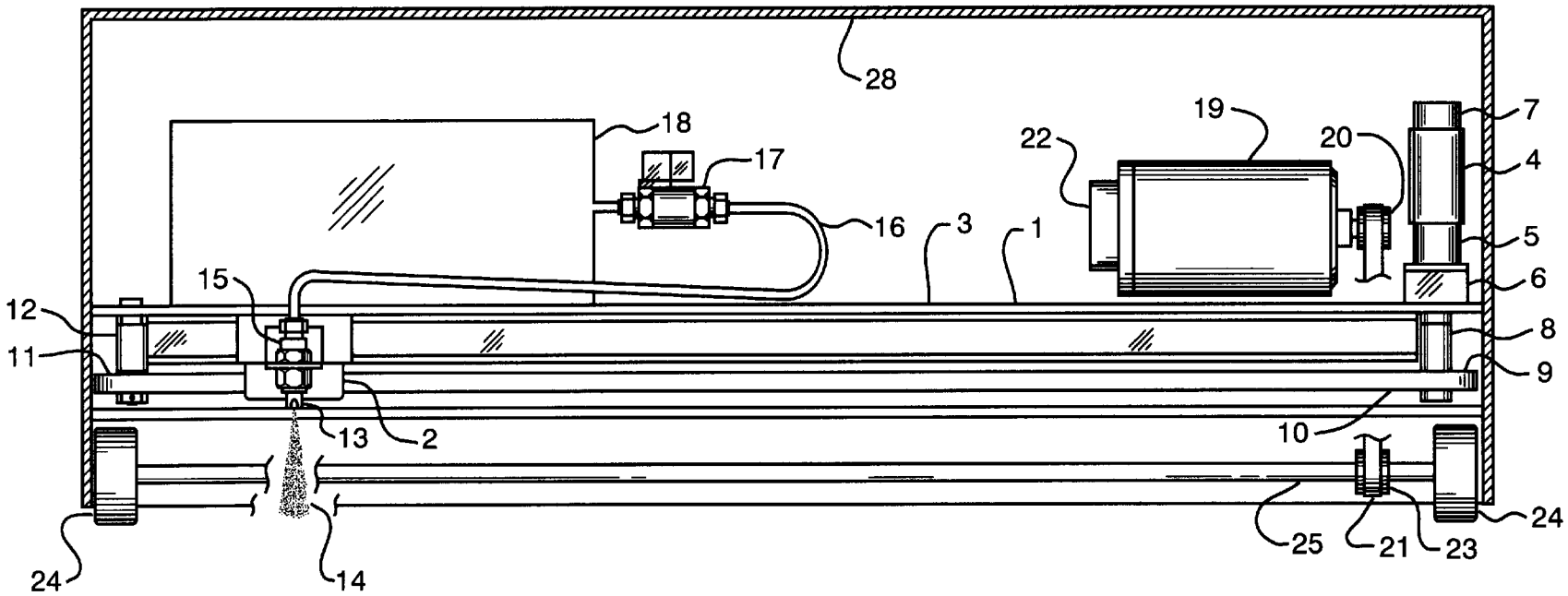
FIG. 1 is a front elevational view of a dressing application device according to one embodiment of the present invention.

Turning to the drawings, FIG. 1 is a front elevational view taken in the longitudinal direction parallel to the length of a bowling lane, of an apparatus according to the present invention. The apparatus comprises a chassis in the form of a reciprocator support frame 1 which carries a reciprocator carriage 2 for transverse movement parallel to the transverse width of a bowling lane, on the support frame 1. Carriage 2 carries a filter housing assembly 15 which is connected to a spray nozzle or nozzle head 13 for discharging an atomized spray 14 of dressing, in particular oil, onto a bowling lane. Carriage 2 is mounted for movement on a reciprocator linear bearing 3 and is moved by a reciprocator drive motor 4 which can be accurately controlled to rotate a drive pulley or sprocket 9 which, with a follower pulley or sprocket 11, trains a timing belt or chain 10 which is connected to carriage 2 for moving carriage 2 at an accurately controlled transverse velocity across chassis 1. A reciprocator speed reducer 5, a reciprocator motor mount assembly 6 and a reciprocator drive bearing housing 8 are connected between motor 4 and pulley 9. The speed of motor 4 is controlled by a speed control and position control sensor 7.

Follower pulley 11 is carried by a follower bearing housing 12 which is connected to the chassis 1. Collectively, the parts 2–12 form reciprocation means and are all known designs and are sufficiently accurate in manufacturing tolerances and controls to accurately apply a selected transverse velocity which can be steady or varied, across the width of the bowling lane. Spray head 13 is supplied with appropriate dressing such as mineral oil, through a flexible fluid delivery hose 16 which is connected to a spray head triggering valve 17 and a fluid supply reservoir 18 for supplying fluid under pressure, either by pressurizing chamber 18 or with use of a fluid pump also schematically illustrated by reference number 17. The fluid flow is controlled by the fluid pressure with or without manual or automatic flow control valves or the displacement rate of a fluid pump.

Spray nozzle or head 13 can be of a conventional hydraulic atomizing nozzle design or air atomizing nozzle design or even an ultrasonic spray nozzle, and reservoir 18 can be pressurized or non-pressurized and include or not include a fluid pump. In any case, it is important that the atomizing spray 14 be accurately controlled for applying dressing to the bowling lane at a selected rate which can be reproduced and maintained. Controls are also provided in the form of valve or pump 17, to accurately vary the selected rate according to one embodiment of the present invention. The application of a selected profile of dressing is achieved through the direct spraying of dressing through atomizing spray 14, directly on to the surface of the bowling lane with the profile being selected by varying either the transverse velocity through the motor 14 and its associated parts, and/or the rate of application at the spray 14, through control of the valve or pump 17 and its associated parts, and even the extent to which the carriage 2 is moved across the transverse width of the bowling lane either completely or in sections or zones, all correlated with the longitudinal velocity of the apparatus along the bowling lane.

The longitudinal movement of the apparatus is achieved by guide means in the form of a drive motor 19 which is mounted to chassis 1, and drives a pulley or sprocket 20 carrying a drive belt or chain 21 engaged around a pulley or sprocket 23 fixed to a drive axle or shaft 25 rotatably mounted to the frame and carrying a pair of drive wheels or rollers 24 connected at opposite ends of axle 25.

The speed of motor 19 is accurately controlled by a known speed control and position control sensor 22 of a known design. Ideally, wheels or rollers 24 are positioned so that they ride within the ball gutter provided on opposite sides of a conventional bowling lane. This accurately directs the frame 1 parallel to the longitudinal direction of the lane and from the foul line to the pit of the bowling lane.

Frame 1 and its associated parts are advantageously covered by a machine housing 26.

Figure 2:
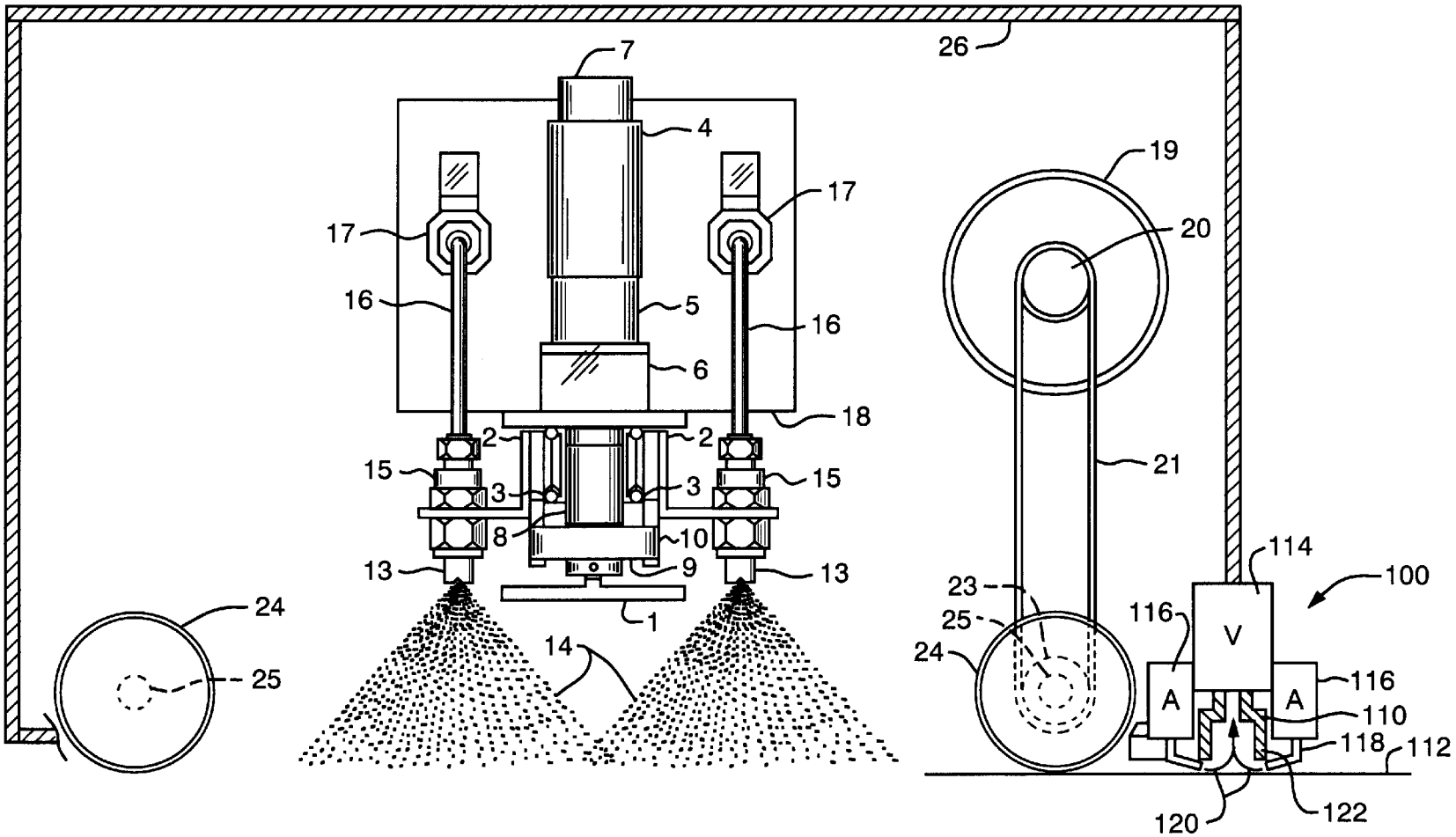
FIG. 2 is a side elevational view of a second embodiment of the device which shares all of the features of the first embodiment except it utilizes two spray heads rather than a single spray head.

In FIG. 2, which is a side elevational view of a second embodiment of the invention taken in the transverse direction of the bowling lane, the same reference numerals are utilized to designate the same or functionally similar parts. In FIG. 2, two carriages 2,2 with associated guides or linear bearings 3 are connected on opposite runs of the belt or chain 10. In this way, when one carriage with its associated nozzle or head 13 moves in one direction, the other carriage moves in the opposite direction and at equal speed. Alternatively, both carriages can be applied to the same side of the belt or chain 10 or separate belts or chains can be provided on chassis 1 to achieve any desired transverse movement in a desired pattern which is achieved by controlling both the transverse velocity of the carriages and the longitudinal velocity of the chassis.

FIG. 2 also illustrates how four wheels or rollers 24 are used to stabilize the rectangular housing 26 on the bowling lane with one pair of rollers being driven and the other pair being idle rollers and simply riding along the gutters.

FIG. 2 also illustrates a vacuum cleaning device 100 which is provided at the upstream end of the dressing apparatus when the dressing apparatus moves from the foul line up toward the pins for removing old dressing and cleaning the bowling lane surface before new dressing is applied. Device 100 comprises a vacuum head 110 which is spaced slightly above the lane surface 112, and is connected to a vacuum pump 114 for drawing old dressing from the bowling lane surface. To help further expedite this cleaning effect, a pair of compressed air devices 116 are connected to a pair of air blades 118 which blow blade shaped streams of air 120 inwardly toward the vacuum inlet from the upstream and downstream ends of the inlet. The inlet, which is shown at numeral 122, is placed about one-quarter inch from the bowling lane surface 112 and the air blades 120,120 that extend across the width of the lane, forcefully push the old dressing up into the vacuum pump 114.

Figure 3A:
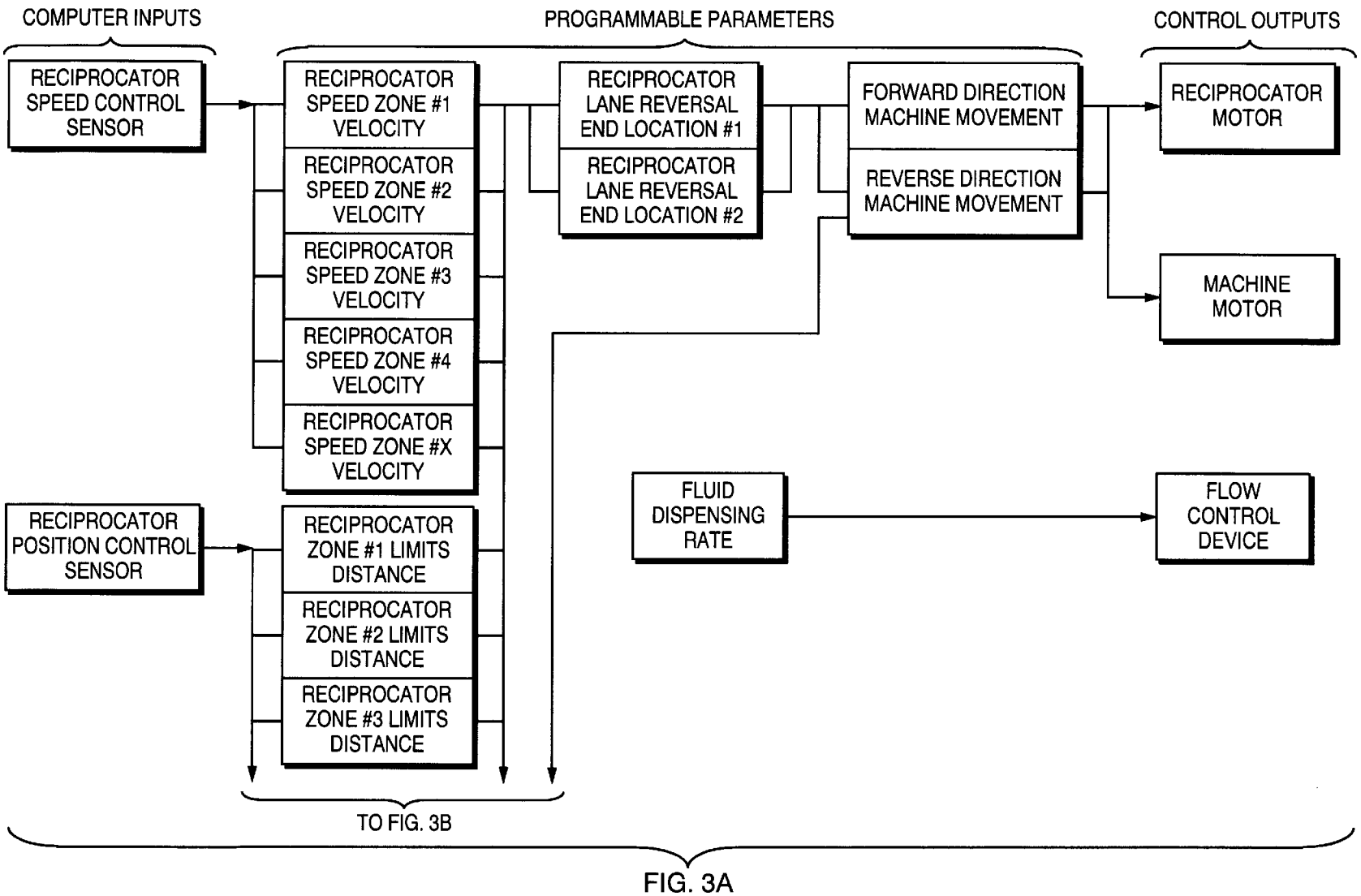
FIGS. 3A and 3B are the respective upper and lower parts of a flow chart illustrating the different parameters which can be varied to apply a dressing with a selected profile, onto a bowling lane.
Figure 3B:
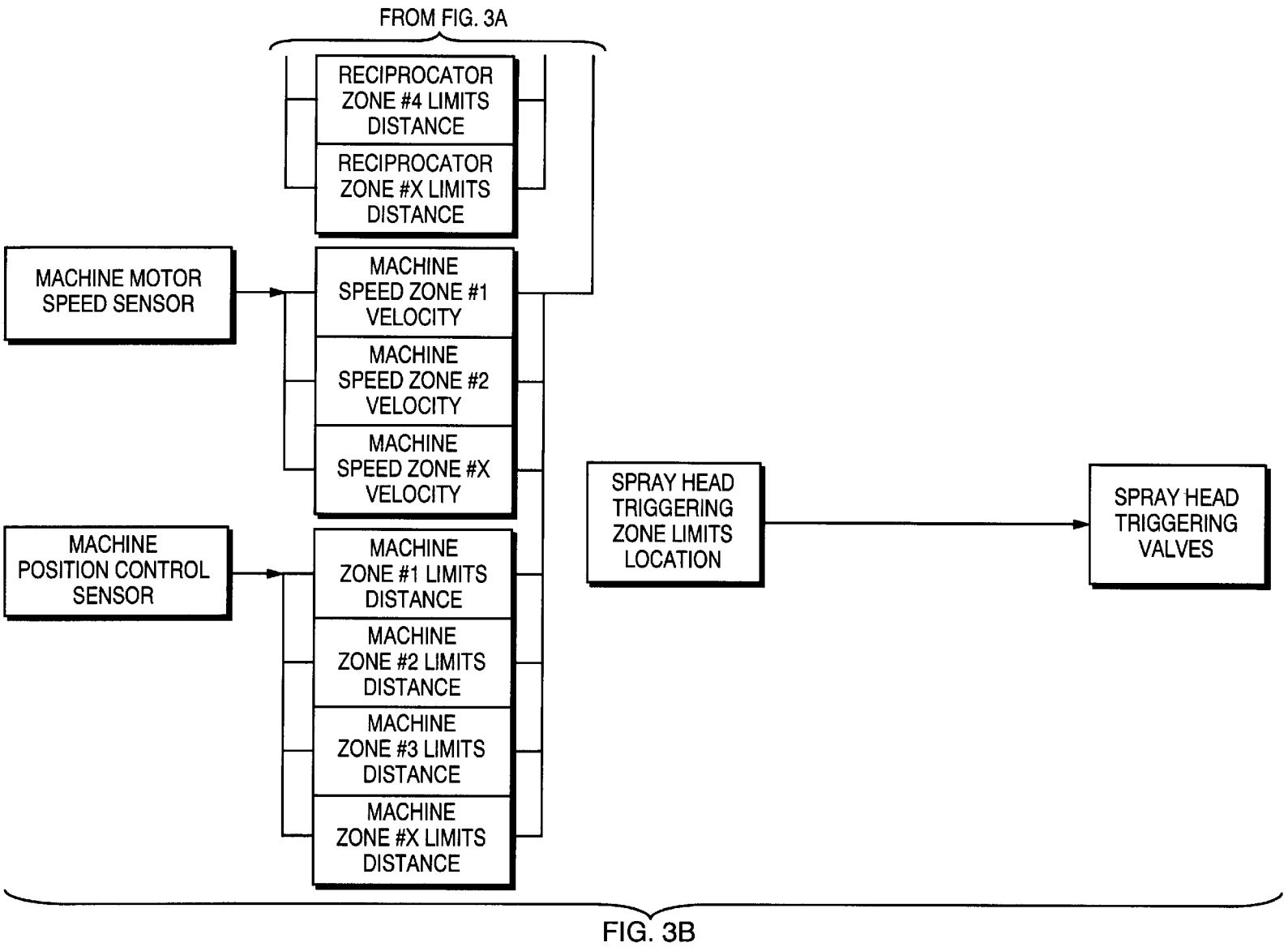
Figure 4:
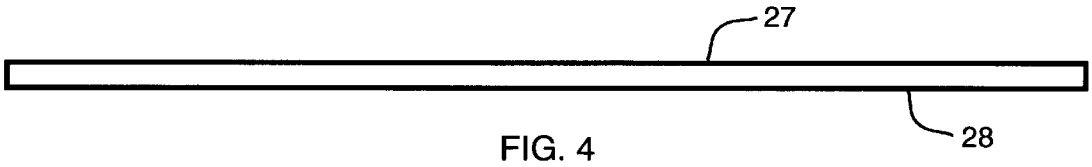
FIG. 4 is a schematic sectional view of a typical dressing profile across the width of a bowling lane applied according to the present invention.
Figure 5:
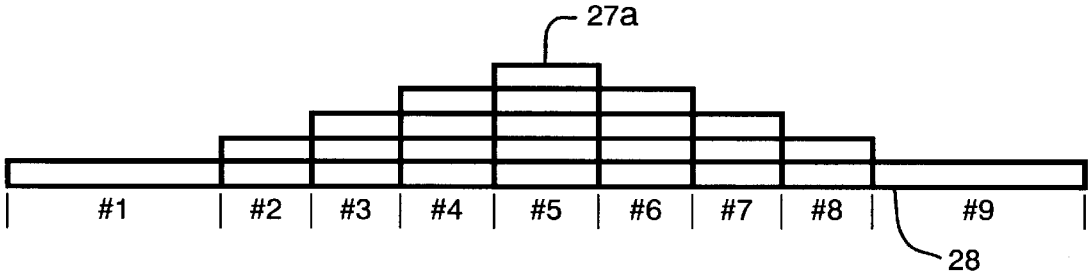
FIG. 5 is a view similar to FIG. 4 illustrating a different profile which can be applied according to the present invention.
Figure 6:
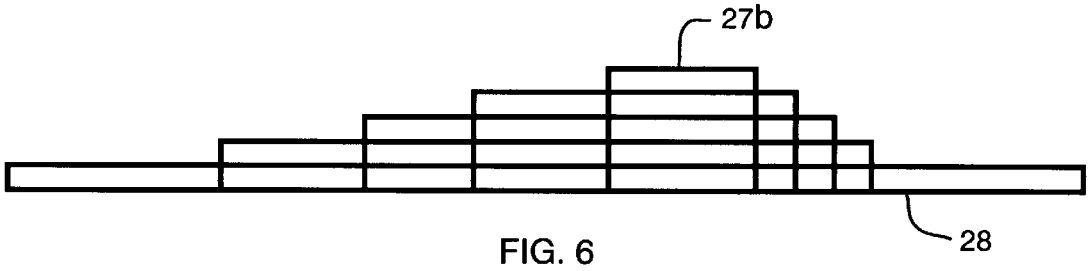
FIG. 6 is a view similar to FIG. 4 of a still further profile which can be applied according to the present invention.

FIG. 3 is a flow chart explaining operation of the present invention which will become apparent by considering FIGS. 4–6.

FIG. 4 is a schematic sectional view taken across the transverse width of a bowling lane 28 and showing an oil film build 27 with its film thickness greatly exaggerated. The conventional transverse width of a bowling lane 28 is forth-two inches. The film 27 is shown to have equal thickness across the entire transverse width and this thickness would be maintained along the longitudinal length of the bowling lane by controlling the transverse velocity to be constant and the metered amount of spray 14 also to be constant.

FIG. 5 illustrates an oil film build or profile 27*a* which is thickest at the center and then symmetrically falls off toward the lateral sides of the lane 28. This profile is achieved by conceptually dividing the transverse width of lane 28 into multiple zones, specifically nine zones in FIG. 5. The thinner end zones which are longer represent areas where the transverse velocity is highest, and are identified by #1 and #9. At zone #2, the transverse speed is reduced to one-half of the speed it had in zone #1 and in zones #3, #4 and #5, the transverse speed is reduced further to one-third, one-quarter and one-fifth of the original speed, respectively.

In zones #6, #7, #8 and #9, the speed is increased in step-wise fashion, back up to one-quarter, then one-third, then one-half, and then one times the original speed. With the metering means operating at constant application rate, varying the transverse speed thus produces profile 27*a*.

In likewise fashion, FIG. 6 illustrates a second profile 27*b* where the speeds in each of the nine zones are varied in step-wise fashion to achieve the desired profile. In this way and with proper timing, as illustrated in FIG. 3, any desired profile across the transverse width of the lane can be achieved.

In another embodiment of the invention which is also properly illustrated by FIGS. 5 and 6, the selected profile can be achieved by maintaining constant transverse velocity, but by varying the metering rate for the amount of oil being sprayed at 14 on to the surface of the bowling lane.

Alternatively, both the metering rate and the transverse speed can be controlled to achieve any desired profile.

Before discussing the various embodiments for the fluid supply mechanisms illustrated in FIGS. 7–10, FIGS. 11 and 12 illustrate two patterns of sprayed dressing which can be laid down along the longitudinal length of a bowling lane 28 which is parallel to the dimension "B". In both patterns, a pair of nozzles or heads 13 are transversely moved in the transverse direction "A" which, as noted above, is forty-two inches in a conventional bowling lane 28. According to a preferred embodiment of the invention, the nozzles are spaced apart by approximately six inches, dimension "B", and move transversely in synchronism with the longitudinal movement of the frame along the bowling lane to produce a "W" pattern which effectively covers the entire surface of the lane. The "W" pattern produced is synonymous with a sign wave. Among the variables that can be controlled with this device, is the ability to vary the amplitude and frequency of the sign wave "W" pattern. When a second atomizer is utilized, it produces an effect on the pattern produced that effectively doubles the frequency without increasing the traverse speed of the reciprocator.

Figure 11:
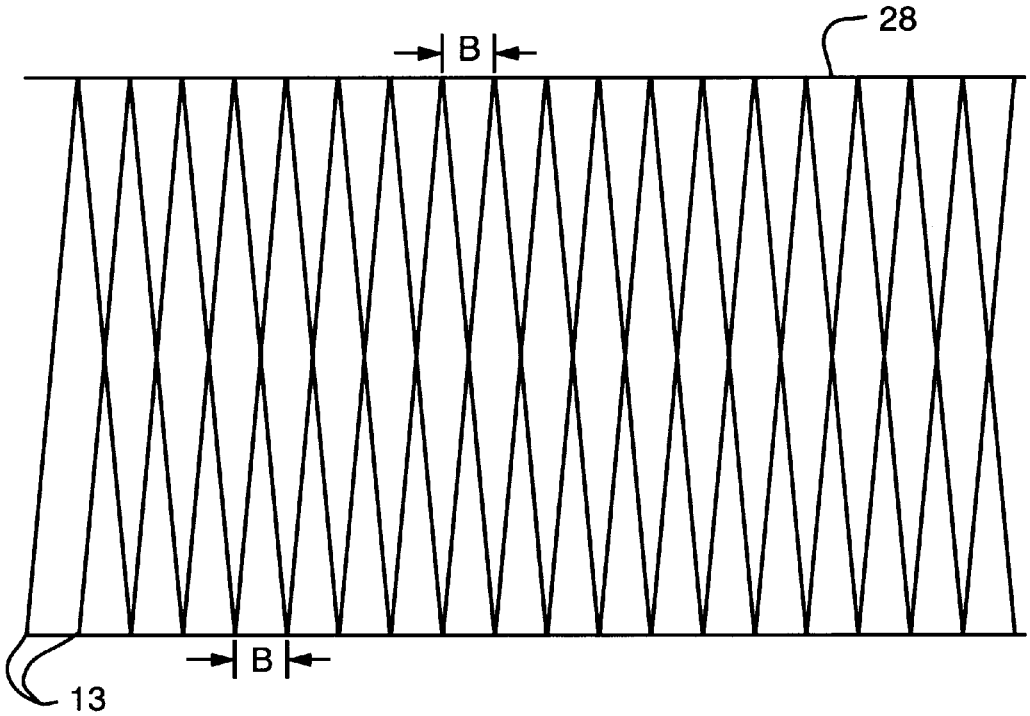
FIG. 11 is a schematic top plan view of a reciprocating pattern which can be applied using two spray heads according to the present invention.
Figure 12:
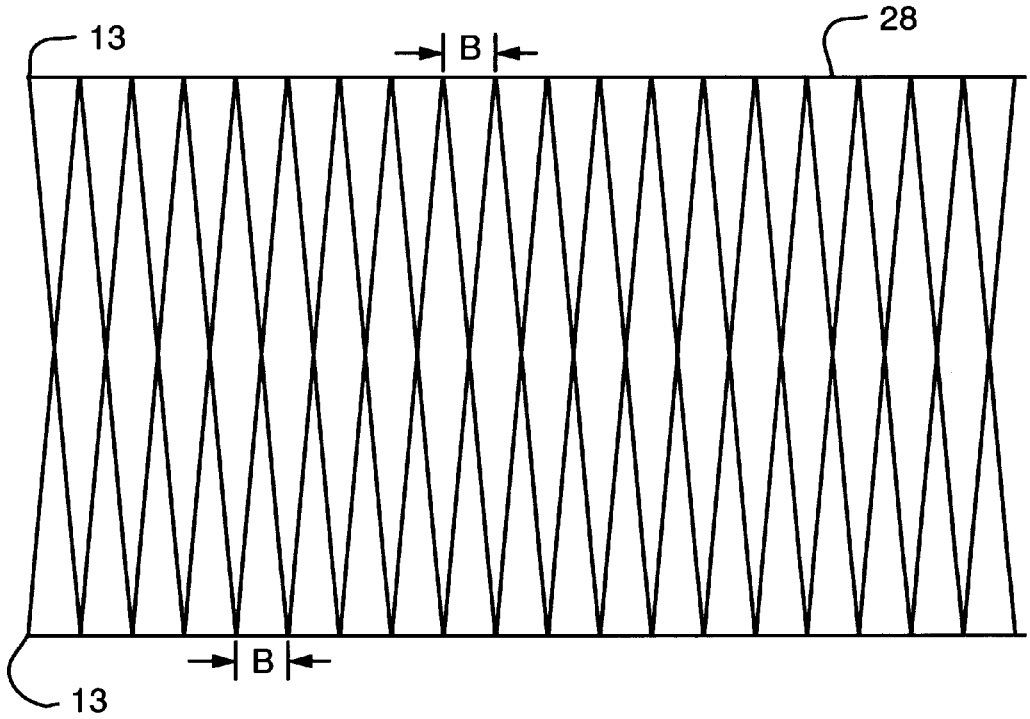
FIG. 12 is a view similar to FIG. 11 of another pattern which can be applied using two spray heads.

FIG. 11 illustrates the case where one carriage carries a pair of nozzles 13 at initial positions on one side of the lane. FIG. 12 illustrates an embodiment where nozzles 13 can be mounted at opposite ends of a chassis by appropriate carriages and reciprocated back and forth to produce a substantially identical pattern but with a different arrangement of nozzles.

Figure 13:
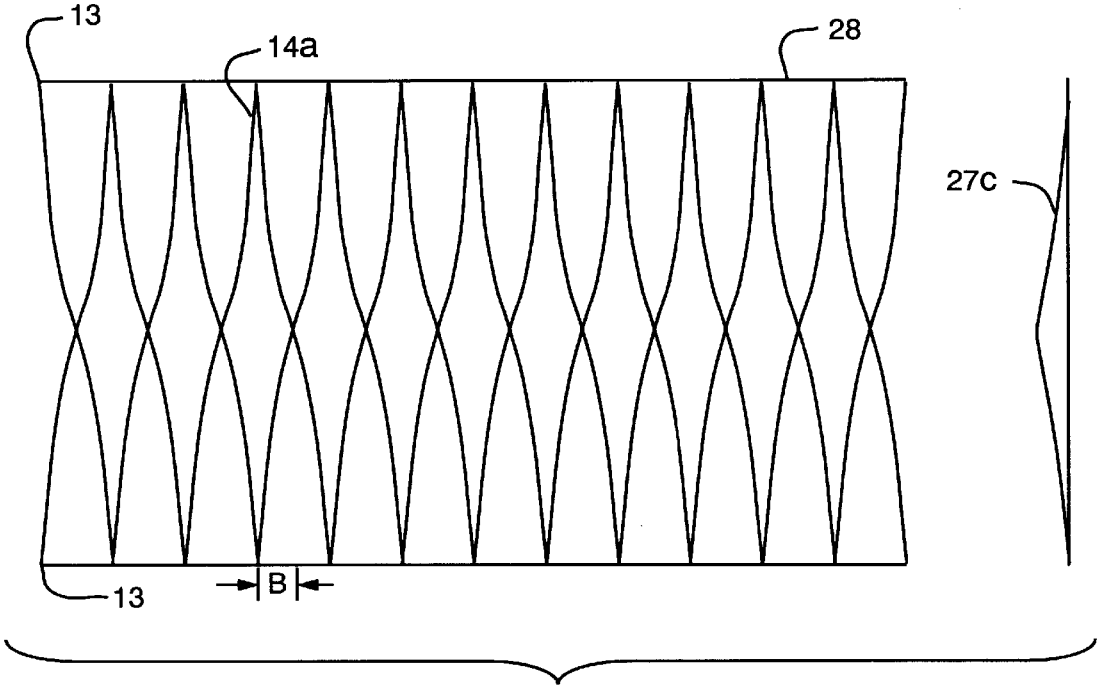
FIG. 13 is a composite top and side sectional view illustrating a further pattern and resulting profile for dressing applied according to the present invention.

FIG. 13 illustrates a further embodiment of the invention wherein a profile 27*c* at the right hand side of the composite FIG. 13 can be achieved by varying the flow rate of oil in a pattern 14*a* laid down transversely across the lane 28.

Figure 14A:
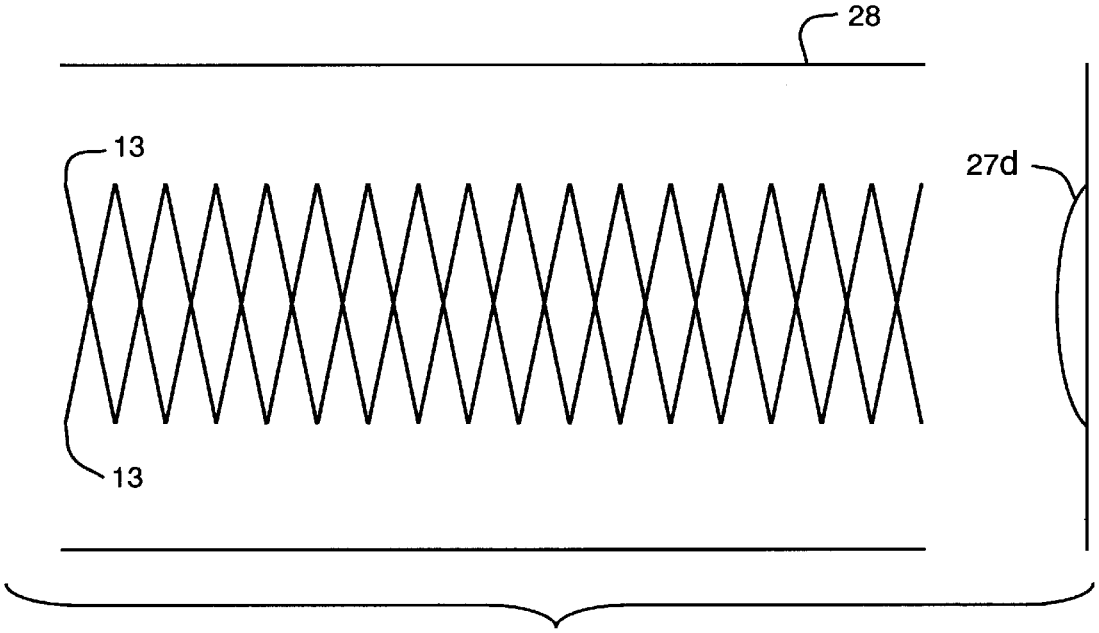
FIGS. 14A and 14B and 14C are views similar to FIG. 13 showing still further application patterns and resulting profiles according to the present invention.
Figure 14B:
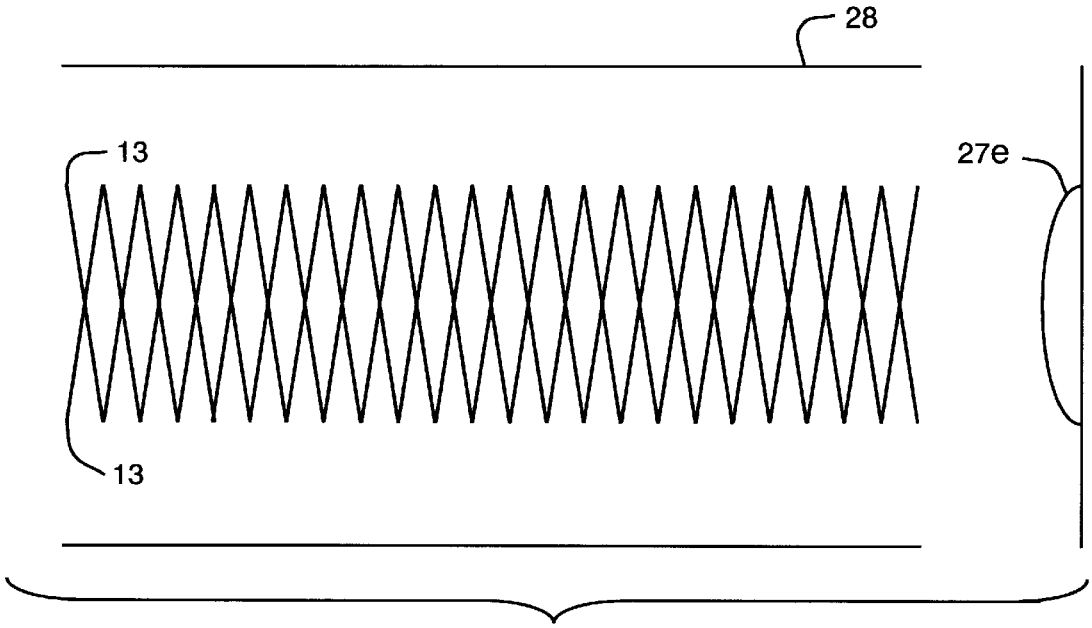

In FIG. 14A, an initial even thickness of film in pattern 27 can be laid down by zig-zag movement of the nozzle(s) across a central part of the lane in section (a) and 27*d* of FIG. 14A. In section (b) of FIG. 14B, a central part, off-set to one side, of the lane receives a repeat application to produce a further profile 27*e*. A third pass in step (c) achieves a final profile 27*f* having a thickest application of oil at the center but near one lateral end of the lane and a thinnest application at the outer lateral ends as shown in FIG. 14C.

Figure 14C:
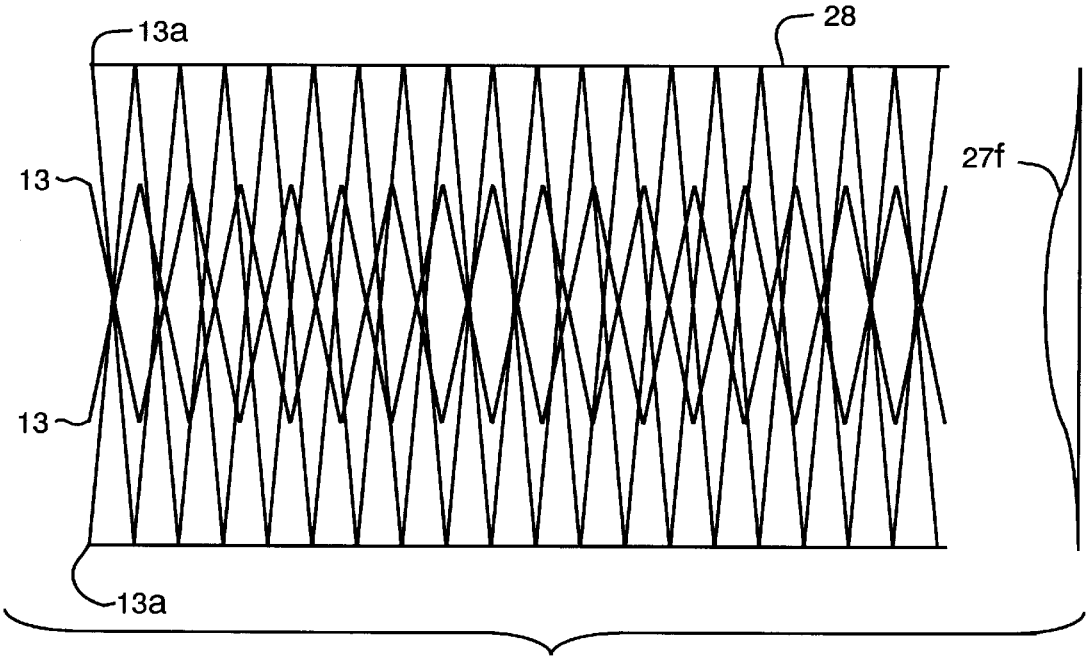

FIG. 14C also illustrates how a different application of the invention can operate by applying a first heavy central coating as the apparatus moves from the foul line toward the pin, to produce the profile and pattern of FIG. 14A, and on a return trip from the pins to the foul line, an overall dusting of dressing is applied in the pattern of FIG. 13. In this way, both the trip up the lane and down the lane are utilized to produce a desired pattern of dressing shown in FIG. 14C.

Figure 7:
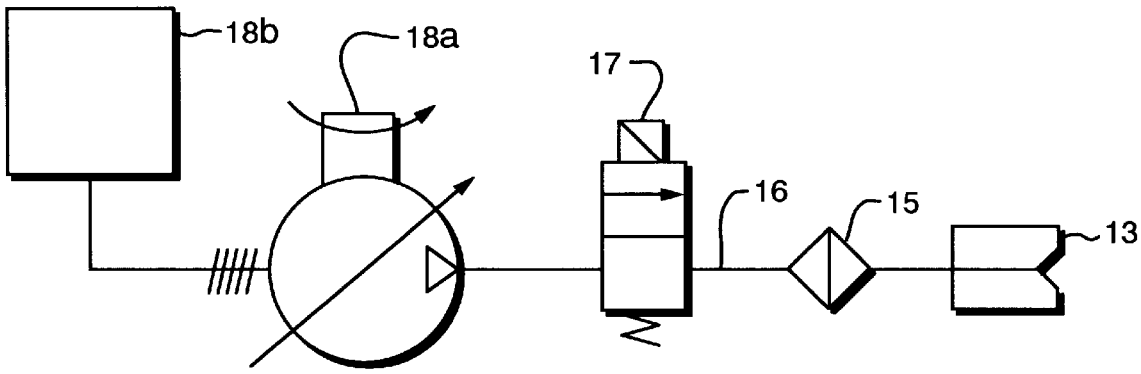
FIG. 7 is a schematic illustration of a fluid delivery system used in accordance with the present invention.

FIG. 7 illustrates a fluid delivery system which utilizes a reservoir 18*b* with a variable displacement pump 18*a* supplying dressing to spray head 13 through valve 17, line 16 and filter housing assembly 15.

Figure 8:
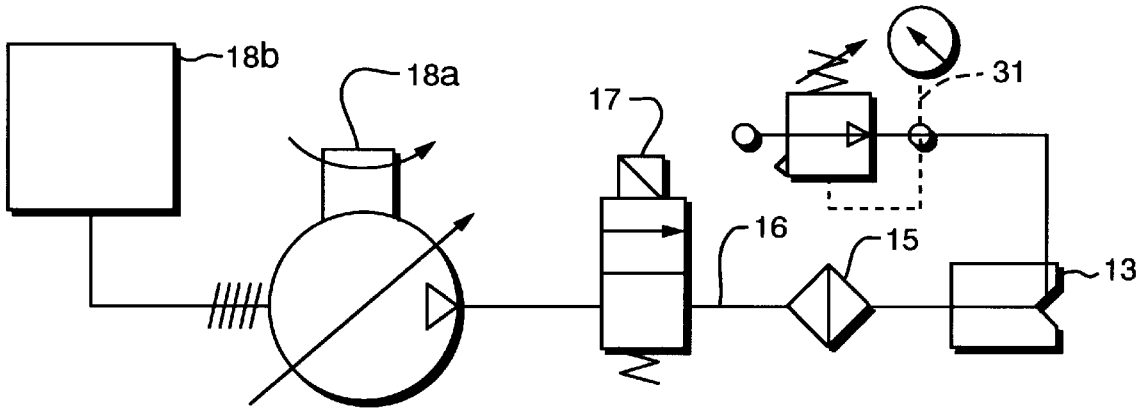
FIG. 8 is a view similar to FIG. 7 of another embodiment of the fluid delivery system.

FIG. 8 illustrates a similar delivery system which, in addition, uses an adjustable air regulator and gauge 31 for an air atomized spray through nozzle 13. Otherwise, the same reference numerals designate the same parts.

Figure 9:
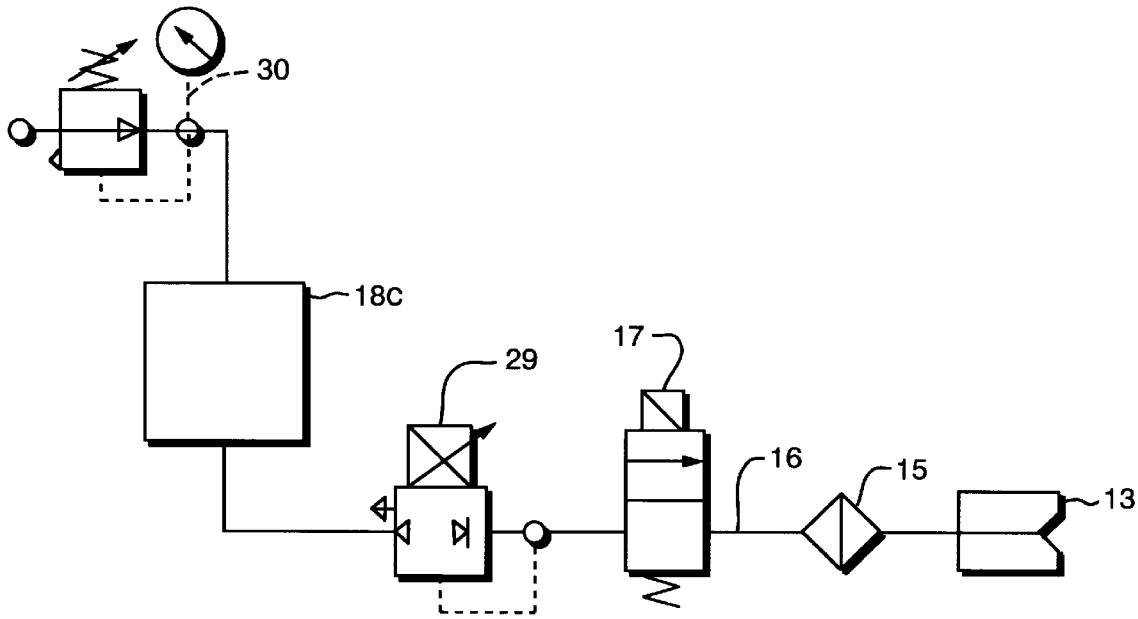
FIG. 9 is a view similar to FIG. 7 of a still further embodiment of the fluid delivery system.

In the embodiment of FIG. 9, an adjustable air regulator and gauge 30 is connected to the pressurized reservoir 18*c* and supplies dressing through a proportional pressure regulator 29 followed by the valve 17, hose 16, filter 15 and nozzle 13.

Figure 10:
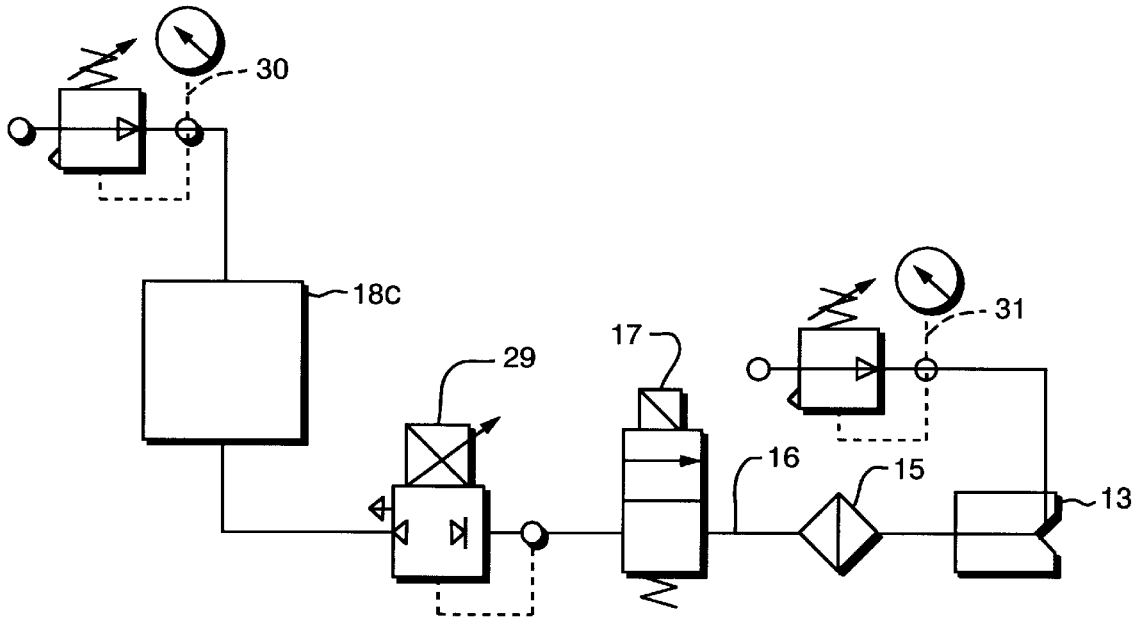
FIG. 10 is a view similar to FIG. 7 of a still further embodiment of the fluid delivery system.

FIG. 10 is a hybrid embodiment including the air regulator 30 and air atomizing equipment 31 of FIGS. 9 and 8, in a single system.

Valves 17 are advantageously fast-acting triggering valves to insure quick start-up and shut-down of the atomizing spray 14. This avoids depositing excess and unwanted dressing film thickness at the ends of each reciprocating stroke where the valves are momentarily shut down while the reciprocating direction is reversed. Variable control using proportional pressure regulator 29 can also be adjusted near the ends of the strokes again to avoid undesired build-up of film thickness. When multiple atomizers are used, triggering valves can selectively shut down an atomizer to enhance the variety of patterns that can be produced.

Figure 15B:
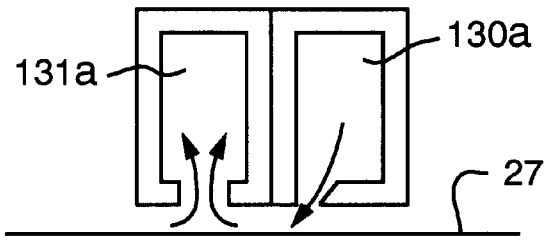
FIG. 15B is a view similar to FIG. 15A of another embodiment of the vacuum cleaning arrangement.
Figure 15A:
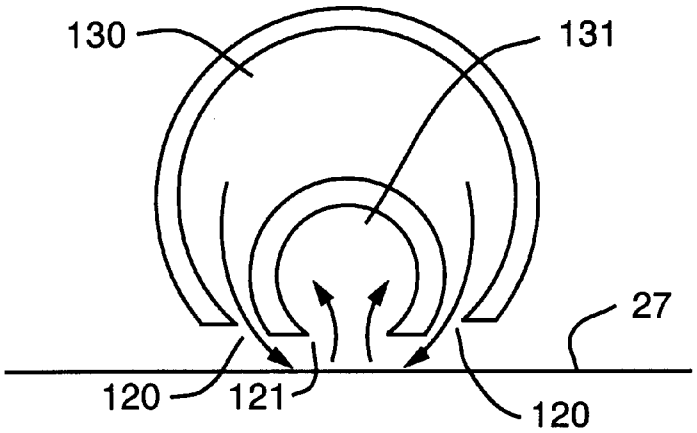
FIG. 15A is an enlarged sectional view of a vacuum cleaning arrangement which can be used instead of the vacuum cleaning arrangement shown in FIG. 2.

FIGS. 15A and 15B show two alternate embodiments of the vacuum cleaning arrangement. In FIG. 15A, the vacuum chamber 131 is surrounded by a compressed air chamber 130. Vacuum chamber 131 produces the vacuum nozzle 121 while the chamber 130 with compressed air produces the upstream and downstream blade shaped air flows 120,120. FIG. 15B shows the downstream placement of the vacuum chamber 131A and the upstream placement of the air blade chamber 130A for respectively producing the vacuum flow and air blade flow.

FIG. 2 also illustrates other embodiments of the drive means for the chassis. The drive wheels 24 may also ride on the lane rather than in the gutter with the idle wheels riding in the gutter. Alternatively, both the idle wheels and the drive wheels can ride on the lane and as a still further alternative, the drive wheels can ride in the gutters, while the idle wheels ride on the lane.

While a specific embodiment of the invention has been shown and described in detail to illustrate the application of the principles of the invention, it will be understood that the invention may be embodied otherwise without departing from such principles.

What is claimed is:

1. An apparatus for applying a liquid dressing to a bowling lane having a longitudinal length and a transverse width, comprising:

a chassis;

guide means connected to the chassis for guiding the chassis for movement along the bowling lane in a longitudinal direct parallel to the longitudinal length and at a longitudinal velocity;

at least one spray nozzle for spraying the liquid dressing onto the bowling lane;

reciprocation means connected between the chassis and the spray nozzle for moving the spray nozzle in a transverse direction parallel to the transverse width of the bowling lane and at a transverse velocity;

metering means for metering liquid dressing to the spray nozzle as the spray nozzle moves in the transverse direction for applying a selected rate of the dressing in a selected pattern across the transverse width; and dressing profile means connected to at least one of the reciprocation and metering means, for varying at least one of the transverse velocity, the selected rate and the selected pattern, for applying the liquid dressing to the bowling lane in a selected profile which varies in thickness across the width of the lane so that the thickness is greater toward the center of the lane than at ends of the lane along the length.

2. An apparatus according to claim 1, wherein the dressing profile means is connected only to the reciprocation means for varying the transverse velocity.

3. An apparatus according to claim 1, wherein the dressing profile means are connected only to the metering means for changing the selected rate.

4. An apparatus according to claim 1, wherein the dressing profile means are connected to both the metering means and the reciprocation means for varying both the selected velocity and the selected rate.

5. An apparatus according to claim 1, wherein the reciprocation means comprises a drive motor for driving the spray nozzle in the transverse direction, the dressing profile means comprising a controller connected to the drive motor for selectively changing the transverse velocity at selected zones into which the transverse width of the lane is divided, lower velocities applying more dressing and higher velocities applying less dressing in each zone selectively.

6. An apparatus according to claim 5, wherein the dressing profile means is constructed to reduce the velocity near central zones to increase the application of dressing in the central zones.

7. An apparatus according to claim 1, wherein the metering means comprises a reservoir mounted to the chassis, a fluid hose connected between the reservoir and the spray nozzle and valving means in the hose for controlling a flow of fluid from the reservoir to the spray nozzle.

8. An apparatus according to claim 7, wherein the reciprocation means comprises a linear bearing extending in the transverse direction and connected to the chassis, a carriage mounted for movement in the transverse direction on the linear bearing, the spray nozzle being mounted to the carriage for movement with the carriage in the transverse direction, the guide means comprising at least two wheels mounted for rotation to the chassis for rolling along gutters of the bowling lane and a drive motor connected to the wheels for rotating the wheels to move the chassis along the lane.

9. An apparatus according to claim 8, wherein the metering means comprises a reservoir for dressing mounted to the chassis, a flexible hose connected between the reservoir and the spray nozzle and valving means connected to the hose for controlling a flow of dressing from the reservoir to the spray nozzle.

10. An apparatus according to claim 1, including cleaning means for removing dressing from a bowling lane, the cleaning means being connected to the chassis.

11. A method for applying a liquid dressing to a bowling lane having a longitudinal length and a transverse width, comprising:

supplying dressing under pressure to a spray nozzle to form an atomized spray;

directing the atomized spray directly against the bowling lane;

reciprocally moving the spray nozzle parallel to the transverse width and at a selected transverse velocity along the transverse width;

longitudinally moving the spray nozzle parallel to the longitudinal length of the bowling lane; and selectively controlling at least one of the supply of dressing to the nozzle and transverse velocity to apply selected pattern of dressing to the bowling lane which varies in thickness across the width of the lane so that the thickness is greater toward the center of the lane than at ends of the lane alone the length.

12. A method according to claim 11, including changing the transverse velocity in steps corresponding to transverse zones into which the transverse width is divided, for varying an amount of dressing applied in each zone to produce the selected profile.

13. A method according to claim 12, including transversely moving at least two spray nozzles, each for spraying dressing on to the bowling lane, to form a "W" pattern along the longitudinal length by reciprocally moving the nozzles in the direction of the transverse width while moving the nozzles in the longitudinal direction.

14. A method according to claim 13, including starting both nozzles at one transverse side of the transverse width to begin the "W" pattern.

15. A method according to claim 14, including starting the nozzles at opposite ends of the transverse width to produce the "W" pattern.

16. A method according to claim 11, including varying the amount of fluid supplied to the nozzle for producing the selected profile.

17. A method according to claim 11, including moving the nozzle through selected amounts of the transverse width during each full movement of the nozzle along the longitudinal length and repeating movement of the nozzle along the longitudinal length for different selected transverse amounts to produce the selected profile.

18. A method according to claim 11, including cleaning the bowling lane before supplying dressing under pressure.

19. A method according to claim 18, including cleaning the bowling lane using an air blade and a vacuum for initially pushing the dressing and then vacuuming it from the bowling lane.

* * * * *